US005440770A

United States Patent [19]

Nichols

[11] Patent Number: 5,440,770

[45] Date of Patent: Aug. 15, 1995

[54] INFANT SEAT WITH OPPOSITE SUPPORTING SURFACES

[75] Inventor: Khipra Nichols, Rumford, R.I.

[73] Assignee: Better Baby Products, Inc., Mountain Lakes, N.J.

[21] Appl. No.: 333,867

[22] Filed: Nov. 3, 1994

Related U.S. Application Data

[63] Continuation of Ser. No. 52,000, Apr. 26, 1993, abandoned.

[51] Int. Cl.[6] ..... A47D 11/00

[52] U.S. Cl. ..... 5/655; 5/603; 5/424

[58] Field of Search ..... 5/603, 655, 652, 424, 5/657, 7.1; 297/3; 128/846, 869

[56] References Cited

U.S. PATENT DOCUMENTS

| | | | |
|---|---|---|---|
| D. 144,404 | 4/1946 | Mabry . | |
| D. 147,581 | 9/1947 | Coulter . | |
| 191,733 | 6/1877 | True . | |
| 902,395 | 10/1908 | Haley . | |
| 1,572,273 | 2/1926 | Elton . | |
| 2,281,629 | 5/1942 | Snow | 5/655 |
| 2,316,602 | 4/1943 | Lee | 5/424 |
| 2,351,849 | 6/1944 | Wells . | |
| 2,440,979 | 5/1948 | Schneider . | |
| 2,709,479 | 5/1955 | Rieger . | |
| 2,876,459 | 3/1959 | Ackerson . | |
| 3,003,815 | 10/1961 | Zinn | 297/3 |
| 3,046,050 | 7/1962 | Fowler | 297/3 |
| 3,235,306 | 2/1966 | Chernivsky . | |
| 3,271,028 | 9/1966 | Albin . | |
| 3,545,016 | 12/1970 | Schorken . | |
| 3,556,586 | 1/1971 | Beardmore . | |
| 3,733,104 | 5/1973 | Carstensen | 5/655 |
| 3,794,379 | 2/1974 | Furey . | |
| 4,241,949 | 12/1980 | Parker | 297/3 |
| 4,359,045 | 11/1982 | Cozzi . | |
| 4,441,221 | 4/1984 | Enste et al. . | |
| 4,471,767 | 9/1984 | Guimond . | |
| 4,593,950 | 6/1986 | Infanti . | |
| 4,598,946 | 7/1986 | Cone . | |
| 4,631,766 | 12/1986 | Semmler | 5/655 |
| 4,862,535 | 9/1989 | Roberts . | |
| 4,873,735 | 10/1989 | Fermaglich et al. . | |
| 4,968,091 | 11/1990 | Mariol | 297/3 |
| 5,160,185 | 11/1992 | Stang | 5/603 |

FOREIGN PATENT DOCUMENTS 2454782 11/1980 France .

OTHER PUBLICATIONS

Reflux Reducer, by Physician Engineered Products, Inc. (undated).

Reflux Wedges and Slings (unauthored and undated).

*Primary Examiner*—Flemming Saether

*Attorney, Agent, or Firm*—Ralph W. Selitto, Jr.

[57] ABSTRACT

An infant support includes a generally wedge-shaped body portion which is adapted to alternatively support an infant in an upwardly-facing reclined position or a downwardly-facing inclined position. The body portion includes opposite first and second supporting surfaces wherein the first supporting surface is contoured to receive the infant in an upwardly-facing, reclined position when the device is supported on the second supporting surface thereof, and the second supporting surface is contoured to receive the infant in a downwardly-facing, inclined position when the device is supported on the first supporting surface thereof.

10 Claims, 2 Drawing Sheets

INFANT SEAT WITH OPPOSITE SUPPORTING SURFACES

This is a continuation of application Ser. No. 08/052,000, filed Apr. 26, 1993, now abandoned.

BACKGROUND OF THE INVENTION

The instant invention relates to infant care devices and more particularly to a device for alternatively supporting an infant in an upwardly-facing reclined position or a downwardly-facing inclined position.

Devices for supporting infants in predetermined positions have heretofore been known in the art. For example, devices of this general character are disclosed in the U.S. Pat. Nos. to Fermaglich et al 4,873,735; Guimond 4,471,767; Roberts 4,862,535; and Enste et al 4,441,221 which represent the closest prior art to the subject invention of which the applicant is aware. In this regard, the patent to Fermaglich discloses a supporting device or perch for infants or handicapped persons in which an individual can be laid out in a prone, generally fetal-like position. On the other hand, the patents to Guimond and Roberts disclose therapeutic beds for the treatment of infants suffering from gastroesophageal reflux. More specifically, the Guimond device includes a inclined bed portion upon which an infant is laid in an inclined prone position, whereas the Roberts device consists of a wedge-shaped pillow having an inclined supporting surface and a sling for maintaining an infant in position on the supporting surface. The patent to Enste et al discloses a support wedge for handicapped children which includes a wedge-shaped base plate, a pair of lateral trough members mounted to the base plate and a plurality of support members which are mountable between the trough members in any desired positional arrangement.

SUMMARY OF THE INVENTION

The instant invention provides a reversible support device for alternatively supporting an infant in an upwardly-facing reclined position or a downwardly-facing inclined position.

Briefly, the device of the subject invention comprises a wedge-shaped body portion having opposite first and second supporting surfaces. The first supporting surface includes a contoured seat portion and a headrest portion for receiving an infant in an upwardly-facing reclined position when the device is supported on the second supporting surface thereof. The second supporting surface comprises an inclined surface and a pair of spaced walls which extend upwardly therefrom when the device is supported on the first supporting surface. The second supporting surface is adapted for receiving an infant in a downwardly-facing inclined position when the device is supported on the first supporting surface thereof. The device further includes a padded liner which is releasably securable to either of the first or second supporting surfaces via snap members. Still further, the device includes an adjustable harness for securing an infant in a desired position on either of the first or second supporting surfaces.

Accordingly, it is an object of the instant invention to provide a device for supporting an infant in a predetermined position.

It is another object to provide a device for supporting an infant in an upwardly-facing reclined position.

It is yet another object to provide a device for supporting an infant in a downwardly-facing inclined position.

It is still another object to provide a reversible device for alternatively supporting an infant in a upwardly-facing reclined position or a downwardly-facing inclined position.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
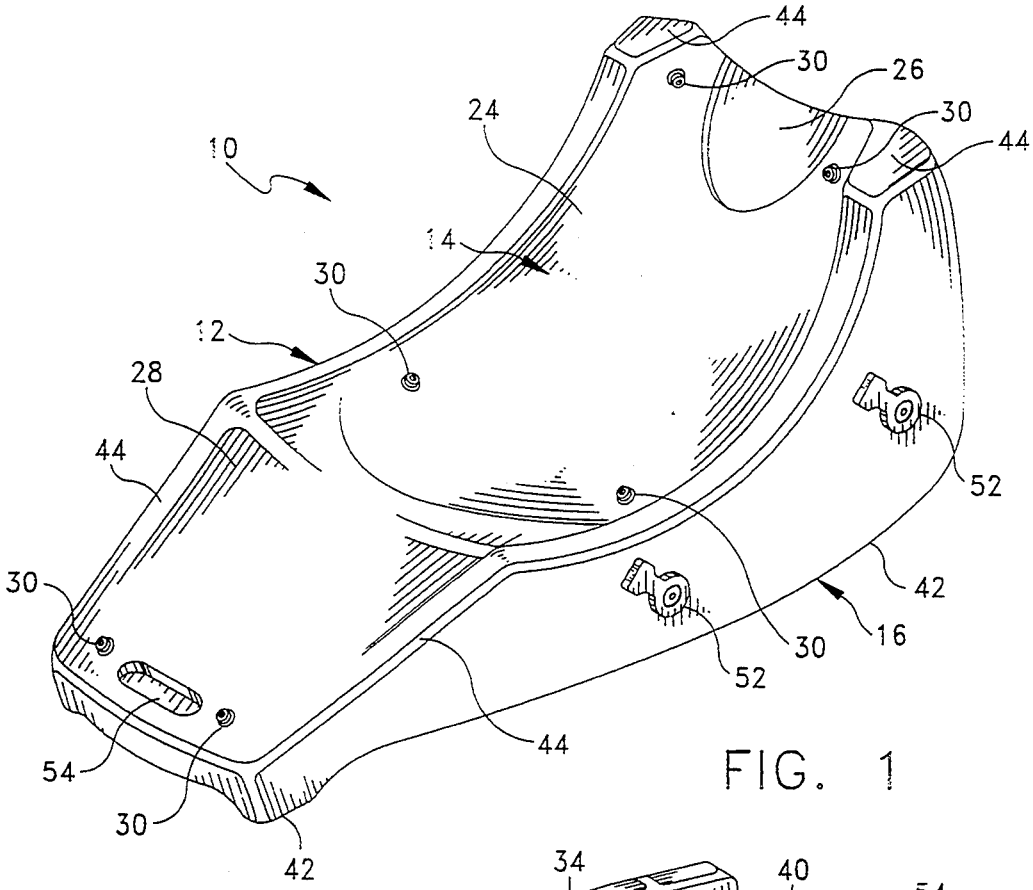
FIG. 1 is a perspective view of the device of the instant invention as positioned with the first supporting surface thereof facing upwardly.

Referring now to the drawings, the device for supporting an infant of the instant invention is illustrated and generally indicated at 10 in FIGS. 1 through 4. The device 10 comprises a wedge-shaped body portion generally indicated at 12 having opposite first and second supporting surfaces generally indicated at 14 and 16, respectively. The device 10 further includes a padded liner generally indicated at 18 and an adjustable harness generally indicated at 20. The body portion 12 is preferably injection molded from a rigid plastic material, and it is adapted to be supported on a flat surface on either of the first or second supporting surfaces 14 and 16, thereof.

Figure 3:
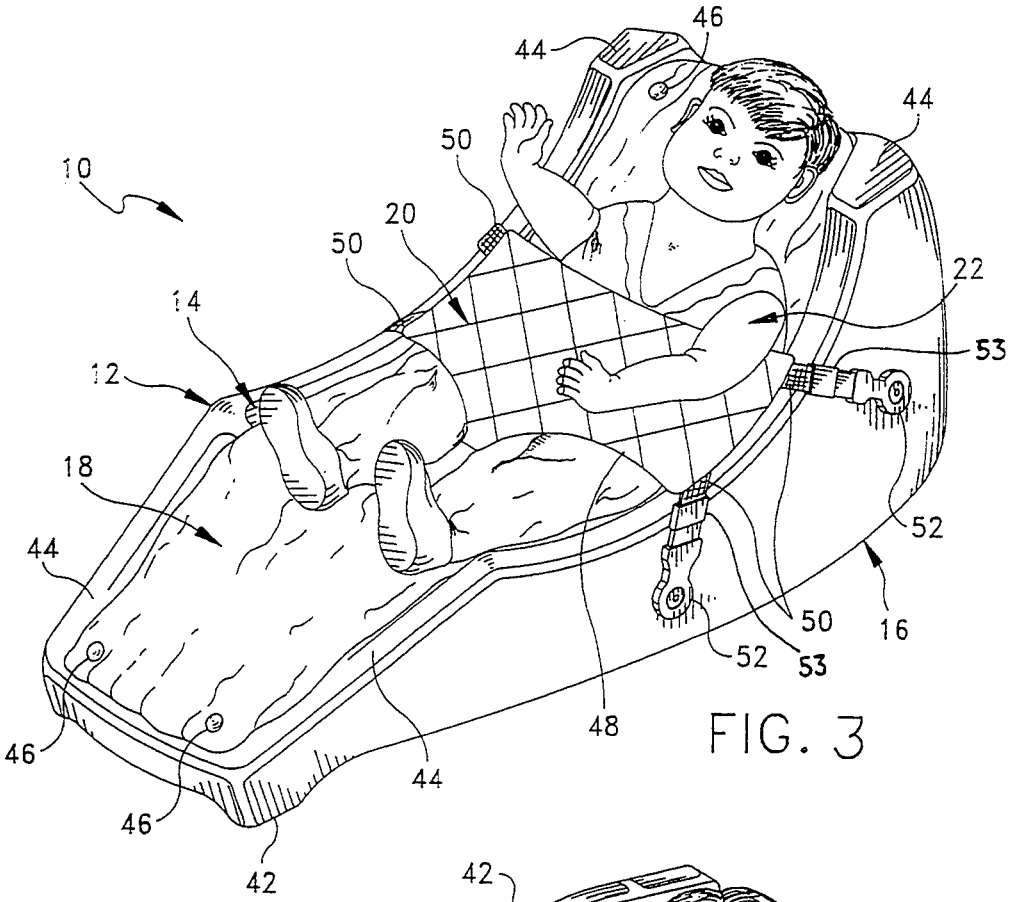
FIG. 3 is yet another perspective view of the device with an infant supported in an upwardly-facing reclined position on the first supporting surface thereof.

The first supporting surface 14 (FIG. 1) is specially contoured to receive an infant 22 in an upwardly-facing reclined position when the device 10 is supported on the second supporting surface 16 thereof, and it includes a generally concave seat portion 24, a slightly recessed head rest portion 26 and a foot rest portion 28 (See FIGS. 1 and 3). The body portion 12 is constructed so that when it is supported on the second supporting surface 16, the first supporting surface 14 is slightly inclined so that when the infant 22 is received in the seat portion 24, the infant's head is supported in a slightly elevated position relative to its feet. The device 10 further includes a plurality of snap members 30 on the first supporting surface 14 for releasably securing the padded liner 18 thereto.

Figure 2:
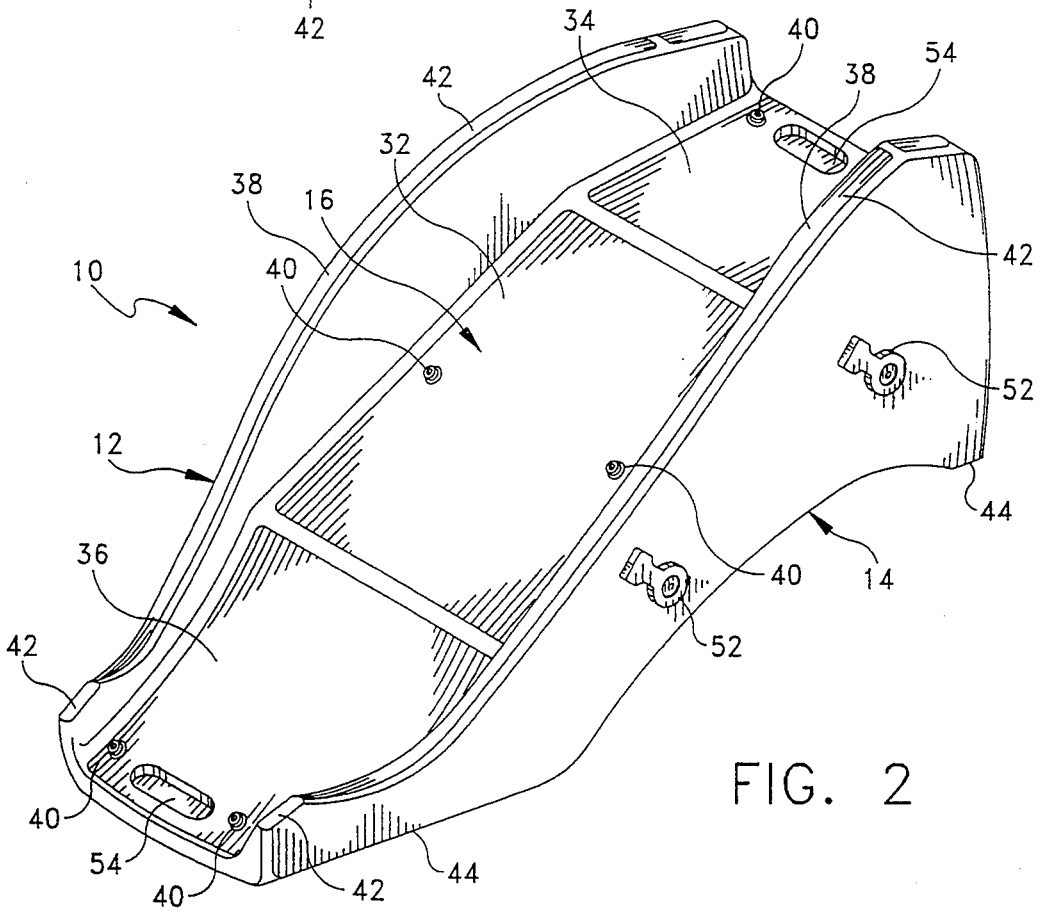
FIG. 2 is another perspective view thereof as positioned with the second supporting surface thereof facing upwardly.
Figure 4:
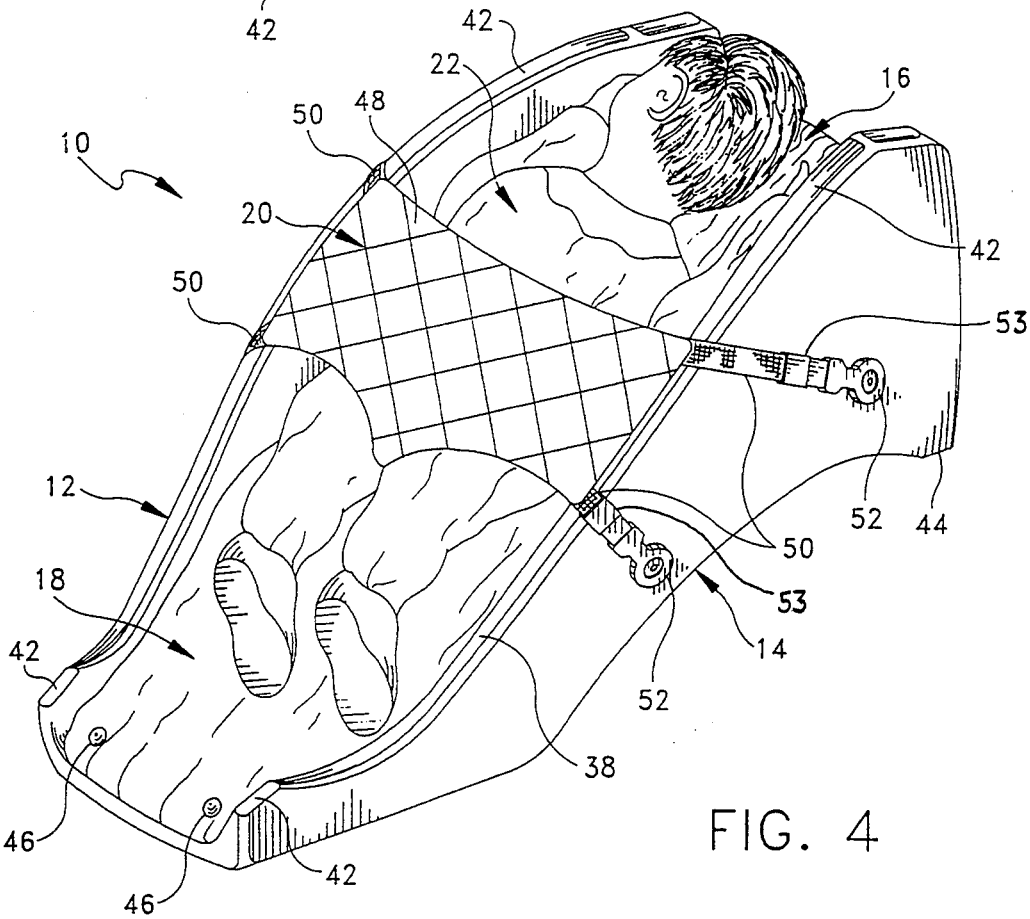
FIG. 4 is still another perspective view of the device with an infant supported in a downwardly-facing inclined position on the second supporting surface thereof.

The second supporting surface 16 is specially contoured for receiving an infant 22 in a downwardly facing inclined position when the device 10 is supported on the first supporting surface 14 thereof (See FIGS. 2 and 4). The second supporting surface 16 is formed as a plurality of inclined surfaces, and it includes a central inclined portion 32 for receiving the body portion of the infant 22, upper and lower inclined portions 34 and 36, respectively, for receiving the head and feet of the infant 22 and a pair of spaced wall portions 38 which extend upwardly along opposite sides of the central, upper, and lower inclined portions 32, 34 and 36, respectively. When the body portion 12 is supported on the first supporting surface 14 thereof, the second supporting surface 16 is inclined at approximately a 30 degree angle so that when the infant 22 is received in a downwardly-facing prone position, its head is supported in a slightly elevated position relative to the infants feet. The spaced wall portions 38 are substantially perpendicular to the second supporting surface 16, and they are effective for preventing the infant 22 from rolling or falling off the side of the device 10. The device 10 also includes a plurality of snap members 40 for releasably securing the padded liner 18 to the second supporting surface 16.

The second supporting surface 16 (FIG. 2) further includes generally flat footing sections 42 at each end of each of the wall portions 38 which are engageable with a flat supporting surface such as a table or a floor to increase the stability of the device 10 when it is received thereon. The first supporting surface 14 (FIG. 1) also includes generally flat footing sections 44 on opposite sides thereof adjacent both the head rest portion 26 and the foot rest portion 28 for increasing the stability of the device 10 when it is received on a supporting surface.

The padded liner 18 is of generally conventional construction, and it includes a plurality of snap members 46 which are positioned to correspond to the snap members 30 and 40 on the first and second supporting surfaces 14 and 16, respectively, Of the device 10. Accordingly, the snap members 46 of the padded liner 18 are alternatively releasably securable in snap-fitting engagement with the snap members 30 and 40 on the first and second supporting surfaces 14 and 16, respectively.

The adjustable harness 20 comprises a sling 48 and a plurality of adjustable strap members 50 for releasably securing the harness 20 to the body portion 12. The strap members 50 are releasably secured to the body 12 by means of conventional interlocking clasp members 52 and 53 which are respectively attached to the body 12 and the straps 50. The clasp 52 is rotatably attached to the side of the body 12 so that it is fully rotatable around 360° of motion (See FIGS. 3 and 4) and the clasp 53 is slidably attached to the strap 50 so that it is slidably adjustable along the length of the strap 50. In use, the sling 48 is received over the torso of the infant 22 (See FIGS. 3 and 4) and the strap members 50 are adjusted for supporting the infant 22 in a desired position.

The first and second supporting surfaces 14 and 16, respectively, are further provided with recessed handle grips 54 (FIGS. 1 and 2) which are easily grasped for transporting or carrying the device 19 12.

It is seen therefore that the instant invention provides an effective reversible device 10 for supporting an infant 22 in two predetermined positions. The first supporting surface 14 of the reversible body portion 12 is adapted for supporting an infant 22 in an upwardly-facing reclined position when the device 10 is supported on the second supporting surface 16 thereof, and the second supporting surface 16 is adapted for supporting the infant 22 in a downwardly-facing inclined position when the device 10 is supported on the first supporting surface 14 thereof. The padded liner 18 and the adjustable harness 20 are releasably securable to either of the supporting surfaces, 14 or 16, of the body portion 12 and further enhance the reversible feature of the body portion 12. For these reasons, the reversible support device 10 of the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An invertible device for supporting an individual, comprising a body integrally formed as a single piece for selectively supporting the individual in a plurality of predetermined positions, said body being invertible between a first orientation and a second orientation and having a first supporting surface with a first contour which is fixed and which is sized and shaped so as to support the individual in a first position, in which the individual is supported in an upwardly facing position with its head at a higher elevation than its legs and torso, when said body is in its said first orientation, and a second supporting surface with a second contour which is fixed and which is sized and shaped so as to support the individual in a second position, in which the individual is supported in a downwardly facing position with its head at a higher elevation than its legs and torso, when said body is in its said second orientation, said first supporting surface having a first footrest portion which is substantially planar and which is located adjacent a lower end of said body, a first headrest portion which has a recess sized and shaped so as to receive the individual's head and which is located adjacent an upper end of said body, and a first seat portion which is generally concave and which is located between said first footrest portion and said first headrest portion, said first seat portion being arranged at a first inclined angle and having an upper edge and a lower edge, said first footrest portion extending downwardly from said lower edge of said first seat portion at a second inclined angle which is different from said first inclined angle, and said first headrest portion extending upwardly from said upper edge of said first seat portion at a third inclined angle which is different from said first inclined angle, and said second supporting surface having a second footrest portion which is substantially planar and which is located adjacent said lower end of said body, a second headrest portion which is substantially planar and which is located adjacent said upper end of said body, and a second seat portion which is substantially planar and which is located between said second footrest portion and said second headrest portion, said second seat portion being arranged at a fourth inclined angle and having an upper edge and a lower edge, said second footrest portion extending downwardly from said lower edge of said second seat portion at a fifth inclined angle which is different from said fourth inclined angle, and said second headrest portion extending upwardly from said upper edge of said second seat portion at a sixth inclined angle which is different from said fourth inclined angle; first engaging means for engaging an underlying support surface to immovably position said body in its said first orientation, in which said first supporting surface faces generally upwardly while said second supporting surface faces generally downwardly, whereby said first supporting surface maintains the individual in its upwardly facing position above the underlying support surface; and second engaging means for engaging the underlying support surface to immovably position said body in its said second orientation, in which said second supporting surface faces generally upwardly while said first supporting surface faces generally downwardly, whereby said second supporting surface maintains the individual in its downwardly facing position above the underlying support surface.

2. The device of claim 1, further comprising restraining means for restraining the individual from rolling or sliding off of said first supporting surface when the individual is supported on said first supporting surface and from rolling or sliding off of said second supporting surface when the individual is supported on said second supporting surface.

3. The device of claim 2, wherein said body further includes a pair of sidewalls positioned on opposite sides of said body.

4. The device of claim 3, wherein said first supporting surface and said second supporting surface are substantially opposed to each other.

5. The device of claim 3, wherein said restraining means includes a harness releasably attached to said body.

6. The device of claim 3, wherein said first engaging means includes a first pair of footings provided on one edge of one sidewall of said pair of sidewalls and a second pair of footings provided on one edge of the other sidewall of said pair of sidewalls.

7. The device of claim 6, wherein said second engaging means includes a third pair of footings provided on an opposite edge of said one sidewall and a fourth pair of footings provided on an opposite edge of said other sidewall.

8. The device of claim 1, wherein said first supporting surface includes at least one handle grip adapted to permit the lifting and carrying of said device.

9. The device of claim 8, wherein said second supporting surface includes at least another handle grip adapted to permit the lifting and carrying of said device.

10. The device of claim 1, further comprising padding means for providing padding on said first supporting surface when said body is in its said first orientation and for providing padding on said second supporting surface when said body is in its said second orientation.

* * * * *